United States Patent [19]

Czelusniak, Jr.

[11] Patent Number: 4,574,716

[45] Date of Patent: Mar. 11, 1986

[54] TUFTING MACHINE WITH MODULAR CONSTRUCTED NEEDLE BARS

[75] Inventor: Paul A. Czelusniak, Jr., Eden, N.C.

[73] Assignee: Fieldcrest Mills, Inc., Eden, N.C.

[21] Appl. No.: 678,072

[22] Filed: Dec. 4, 1984

[51] Int. Cl.[4] ..... D05C 15/00

[52] U.S. Cl. ..... 112/79 R; 66/214

[58] Field of Search ..... 112/79 R; 66/214

[56] References Cited

U.S. PATENT DOCUMENTS

| | | | |
|---|---|---|---|
| 3,485,195 | 12/1969 | Torrence | 112/79 R |
| 3,618,542 | 11/1971 | Zocker | 112/79 R |
| 4,092,838 | 6/1978 | Gangi | 66/214 |
| 4,138,956 | 2/1979 | Parsons | 112/79 R |
| 4,157,690 | 6/1979 | Lund et al. | 112/79 R |
| 4,170,949 | 10/1979 | Lund | 112/79 R |
| 4,398,479 | 8/1983 | Czelusniak | 112/79 R |

*Primary Examiner*—Ronald Feldbaum

*Attorney, Agent, or Firm*—Bell, Seltzer, Park & Gibson

[57] ABSTRACT

A modular construction of needle bars wherein each of the modular units thereof comprises a mounting bracket having a first flange portion and a second flange portion arranged at right angles to each other and wherein a plurality of tufting needles each having a shank portion and an opposing tapered end having a transversely arranged yarn receiving eye therein are secured to the first flange by the shank portions of the needles being soldered thereto so that the needles are in uniformly spaced apart parallel relation with the eyes of the needles in alignment with each other.

4 Claims, 6 Drawing Figures

TUFTING MACHINE WITH MODULAR CONSTRUCTED NEEDLE BARS

This invention relates to tufting machines and more particularly to multi-needle bar tufting machines for the forming of pile tufted fabrics of a wide variety of patterns.

This invention is particularly applicable to shiftable and registrable needle bars of the type as disclosed in my earlier U.S. Pat. No. 4,398,479 wherein the needle bars are adapted to be shogged relative to each other for forming a wide variety of pattern effects and so that the needles of the respective bars may be registered with each other to form a single row of needles, all in alignment with each other during each active stroke of the needles in penetrating the base fabric and in the forming of pile tufts thereon. My aforementioned patent while disclosing several types of constructions of needle bars, presents a common problem that the instant invention is more particularly directed to overcoming. Specifically, it has been learned that it is not only tedious, time consuming and very expensive to attempt to form needle bars as disclosed in my aforementioned patent wherein holes have to be very carefully bored through the needle bars for receiving the needles therein, but also wherein errors in boring the holes are compounded with the result that the needles on the pairs of cooperating bars would not properly register with each other for forming a single row of transversely aligned needles.

Further, in my prior patent, in one embodiment different lengths of needles were utilized for the cooperating needle bars, and in another embodiment the needles were bent in an offset manner for accommodating being positioned in alignment with each other. In both contructions, modification had to be made to conventional linear needles which further added to the unfavorable economics in the manufacture of the needle bars.

With the foregoing in mind, it is the primary object of this invention to provide a greatly improved needle bar construction and more particularly a needle bar construction formed of modular units each of which comprises a simple mounting bracket with a plurality of identical tufting needles of conventional linear type suitably secured by soldering to the mounting bracket in uniformly spaced apart parallel relation with the eyes of the needles in alignment with each other. By this arrangement, detailed machining and boring of the needle bars and modification of the tufting needles is completely eliminated, as well as any compounding of machinery errors as in the past.

It is a more specific object of this invention to provide a modular construction of needle bars wherein each of the modular units thereof comprises a mounting bracket having a first flange portion and a second flange portion arranged at right angles to each other and wherein a plurality of tufting needles each having a shank portion and an opposing tapered end having a transversely arranged yarn receiving opening or eye therein are secured to the first flange by the shank portions thereof being soldered to the first flange portion so that the needles are in uniformly spaced apart parallel relation with the eyes of the needles in alignment with each other. Simple fastener means cooperate with the second flange portions of the modular units for mounting the modular units on an elongate bar with the eyes of all the tufting needles in alignment with each other and with all the needles in uniformly spaced apart parallel relation to each other.

Some of the objects and advantages of the invention have been stated, others will appear as the description proceeds when taken in connection with the accompanying drawings, in which FIG. 1 is a fragmentary vertical sectional view through needle bars of a tufting machine embodying the present invention;

While this invention will now be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

Although the invention has been illustrated with particular application to shiftable needle bars having registrable needles of the type as disclosed in my earlier U.S. Pat. No. 4,398,479, it will be understood that this invention may be applied to various other types of conventional needle bars for tufting machines.

Figure 1:
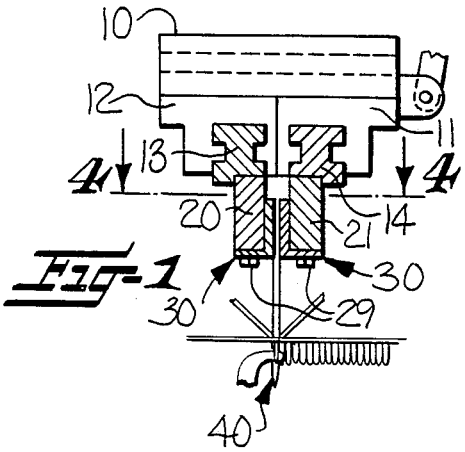
Figure 2:
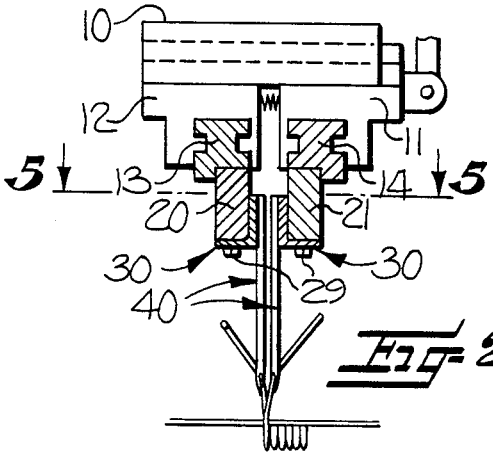
FIG. 2 is a view similar to FIG. 1 but illustrating the rows of needles out of registration with each other.

Referring now more particularly to the drawings, it will be noted that reference numeral 10 broadly indicates a supporting member suitably carried on the tufting machine and from which are supported needle bar carrier members 11 and 12 with member 11 being mounted for transverse horizontal sliding movement toward and away from carrier member 12 as best illustrated by comparing the position of carrier member 11 in FIG. 2 with that in FIG. 1. In turn supported from carrier members 11 and 12 are longitudinally slideable rail members 13 and 14 to the lower portions of which are suitably secured respective needle bars 20 and 21. Each of the needle bars 20, 21 in their underside have vertically arranged threaded bores **20*a*, 21*a* respectively for the purpose of mounting modular units 30 of tufting needles thereon. As illustrated, conventional threaded fastener screws 29 serve for effecting the mounting of the modular units on the respective needle bars 20 and 21**.

Each of the modular units 30 of tufting needles comprises a bracket 31 shown in the form of an angle bracket having a first flange portion 32 and a second flange portion 33 arranged at right angles to each other with the second flange portion 33 having a pair of openings or holes **33*a* therethrough for the purpose of effecting mounting of the bracket 31 on the respective needle bars 20, 21 by the fasteners 29. Mounted on the outer face of the first flange portion 32 are a plurality of tufting needles 40** which are positioned in uniformly spaced apart parallel relation on the flange portion with the eyes of the needles in alignment with each other and are held in this position by suitable solder means S.

Each of the tufting needles 40 comprises a shank portion 40*a* and an opposing tapered end 40*b* having a transversely arranged yarn receiving eye 40*c* therein. It will be noted that a substantial portion of the shank portion 40*a* of each of the tufting needles 40 is secured by solder means S to the first flange portion 32 and that the shank portion overlaps over half the width of the first flange portion whereby each tufting needle has a substantial extent thereof secured to the first flange portion 32.

Figure 3:
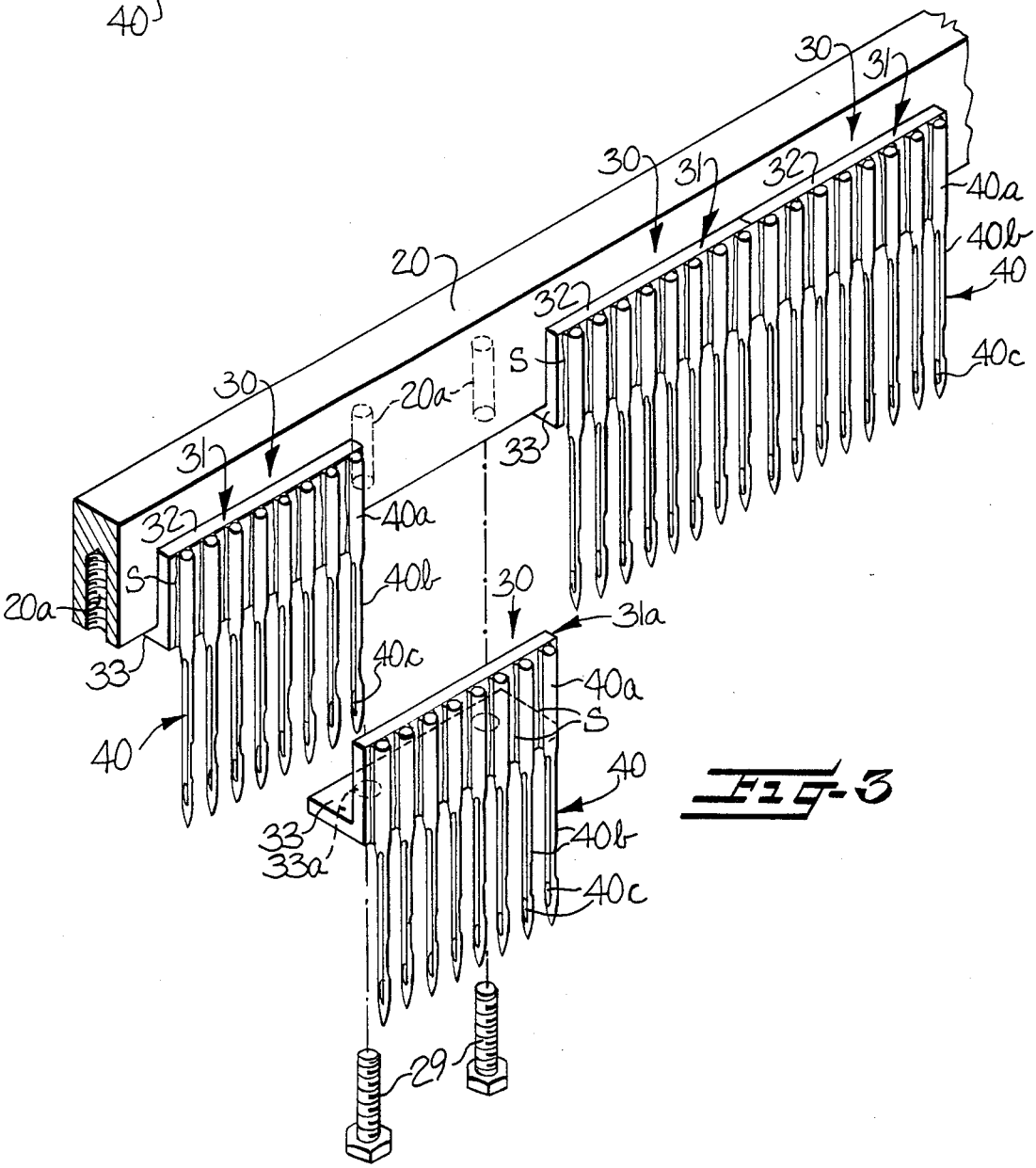
FIG. 3 is a fragmentary perspective view of one of the needle bars with parts broken away for illustrating the modular construction.

It will be noted as best shown in FIG. 3 that the modular units of tufting needles are arranged on the respective needle bars so that the inner faces of the first and second flanges are in engagement with the needle bar and that the mounting brackets 30 are in abutting relationship to facilitate providing uniform spacing of the tufting needles throughout the needle bar.

Figure 4:
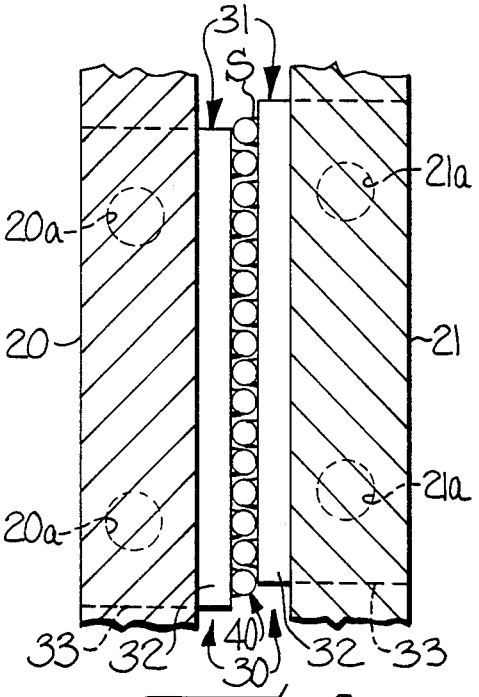
FIG. 4 is a horizontal sectional view taken along line 4—4 of FIG. 1 and on a larger scale.
Figure 5:
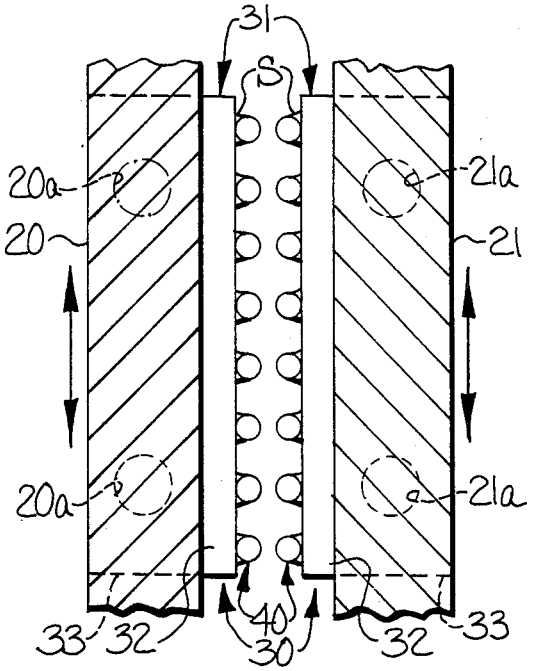
FIG. 5 is an enlarged horizontal sectional view taken along line 5—5 of FIG. 2.
Figure 6:
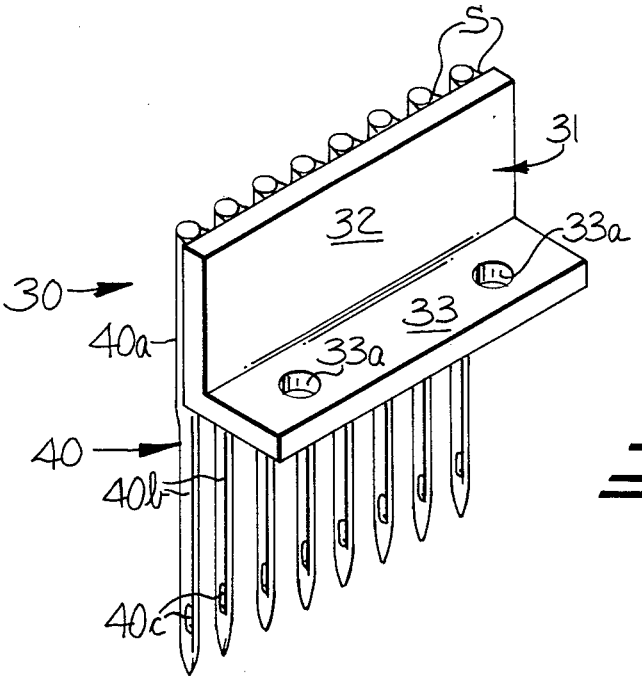
FIG. 6 is a perspective view of one of the modular units of tufting needles.

Referring now to FIGS. 4 and 5 it will be seen that through use of solder means S as the securing means for the tufting needles to the mounting brackets 30, the tufting needles 40 may be positioned in very close relationship to each other so as to provide a needle bar construction of fine gauge, so as to make fabrics of fine gauge. As an example, the tufting needles 40 on each of the presently constructed prototype modular units 30, of this invention, are positioned so as to be of a gauge of 5/16 inch, i.e. from point to point of the tufting needles. When the needle bars 20, 21 are in registration as shown in FIG. 4, the resulting gauge is 5/32 inch. It will now be noted by comparing FIGS. 4 and 5 that the space between the tufting needles on the respective needle bars is only slightly greater than the cross-sectional dimension of the shank of each of the tufting needles. Thus when the needle bars are positioned in registered alignment with each other as illustrated in FIGS. 1 and 4 preparatory to forming a row of pile loops P in the fabric F, it will be seen that a very fine density of tufted pile fabric can be manufactured.

While the instant invention permits a fine gauge tufting needle bar construction to be effected in a very efficient and precise manner, it should also be appreciated that the modular construction of the needle bars permits relatively easy maintenance in the event a tufting needle is damaged and needs to be replaced. If this occurs it is merely necessary to remove a pair of fasteners 29 to then remove the entire modular unit of tufting needles and replace the same.

In the drawings and specification there has been set forth the preferred embodiment of the invention and, although specific terms are employed, they are used in a generic and descriptive sense only, and not for purposes of limitation, the scope of the invention being defined in the claims.

That which is claimed is:

1. A needle bar of modular construction for use in a tufting machine and comprising an elongate bar and a plurality of aligned modular units of tufting needles carried by said bar, each of said modular units comprising a mounting bracket having a first flange portion and a second flange portion arranged at right angles to each other, said flanges having inner and outer faces with the inner faces of the respective flanges being in engagement with said elongate bar, a plurality of tufting needles each having a shank portion and an opposing tapered end having a transversely arranged yarn receiving eye therein, said shank portions of said needles being juxtaposed to the outer face of said first flange, solder means securing said tufting needles to the outer face of said first flange portion in uniformly spaced-apart parallel relation with the eyes of said needles in alignment with each other, and fastener means cooperating with said second flange portions of said modular units for mounting the modular units on said elongate bar with the eyes of all of the tufting needles in alignment with each other and with all of the needles in uniformly spaced-apart parallel relation to each other.

2. A needle bar of modular construction according to claim 1 wherein the shank portions of said juxtaposed tufting needles overlap substantially over one-half the height of said first flange portion and wherein said solder means extends along and secures substantially the entire overlapping shank portion to the outer face of said first flange portion whereby each tufting needle has a substantial extent thereof firmly secured to said first flange portion.

3. A modular construction of tufting needles wherein a plurality of modular units of tufting needles may be mounted on a needle bar for use in a tufting machine, each of said modular units of tufting needles comprising a mounting bracket having a first flange portion and a second flange portion arranged at right angles to each other, said flanges having inner and outer faces with the inner faces of the respective flanges being adapted to engage the needle bar, a plurality of tufting needles each having a shank portion and an opposing tapered end having a transversely arranged yarn receiving eye therein, said shank portions of said needles being juxtaposed to the outer face of said first flange, solder means securing said tufting needles to the outer face of said first flange portion in uniformly spaced-apart parallel relation with the eyes of said needles in alignment with each other, and openings in said second flange portion adapted to receive fastener means for mounting the modular unit of tufting needles on a shiftable needle bar of a tufting machine.

4. A modular construction according to claim 3 wherein the shank portions of said tufting needles overlap substantially over one-half the height of said first flange portion and wherein said solder means secures substantially the entire overlapping shank portion to the outer face of said first flange portion whereby each tufting needle has a substantial extent thereof firmly secured to said first flange portion.

* * * * *